US006173148B1

(12) United States Patent
Matsuda et al.

(10) Patent No.: US 6,173,148 B1
(45) Date of Patent: Jan. 9, 2001

(54) IMAGE FORMING APPARATUS WITH A TRANSFER MEMBER HAVING AN INHERENT VOLUME RESISTANCE LESS THAN THAT OF AN INNER LAYER OF A TRANSPORT SUPPORT ELEMENT

(75) Inventors: Itaru Matsuda, Yokohama; Chiemi Kaneko, Toride; Ryou Tanoue, Yokohama, all of (JP)

(73) Assignee: Ricoh Company, Ltd., Tokyo (JP)

( * ) Notice: Under 35 U.S.C. 154(b), the term of this patent shall be extended for 0 days.

(21) Appl. No.: 09/249,073

(22) Filed: Feb. 12, 1999

(30) Foreign Application Priority Data

| | | |
|---|---|---|
| Feb. 14, 1998 | (JP) | 10-048626 |
| Feb. 27, 1998 | (JP) | 10-064279 |
| Mar. 13, 1998 | (JP) | 10-063489 |

(51) Int. Cl.[7] ..... G03G 15/16
(52) U.S. Cl. ..... 399/310; 399/308; 399/313
(58) Field of Search ..... 399/310, 313, 399/314, 308

(56) References Cited

U.S. PATENT DOCUMENTS

| | | | | |
|---|---|---|---|---|
| 5,189,479 | | 2/1993 | Matsuda et al. | 399/300 |
| 5,406,360 | * | 4/1995 | Asai | 399/313 |
| 5,461,461 | | 10/1995 | Harasawa et al. | 399/66 |
| 5,495,317 | | 2/1996 | Matsuda et al. | 399/313 |
| 5,515,146 | | 5/1996 | Harasawa et al. | 399/310 |
| 5,552,871 | * | 9/1996 | Kutsuwada et al. | 399/313 |
| 5,557,384 | | 9/1996 | Takano et al. | 399/313 |
| 5,572,304 | * | 11/1996 | Seto et al. | 399/313 |
| 5,640,660 | | 6/1997 | Takano et al. | 399/313 |
| 5,655,200 | * | 8/1997 | Oyama | 399/313 |
| 5,659,843 | | 8/1997 | Takano et al. | 399/314 X |
| 5,666,622 | | 9/1997 | Harasawa et al. | 399/313 |
| 5,812,919 | | 9/1998 | Takano et al. | 399/313 X |
| 5,832,351 | * | 11/1998 | Takekoshi et al. | 399/313 |

OTHER PUBLICATIONS

Japanese Patent Abstract No. 5–127546, date May 25, 1993; Title: Image Forming Device.
Japanese Patent Abstract No. 7–013440, date Jan. 17, 1995; Title: Transfer Belt Device.
Japanese Patent Abstract No. 8–152789, date Jun. 11, 1996; Title: Belt Transfer Device.
Japanese Patent Abstract No. 9–073239, date Mar. 18, 1997; Title: Transfer Separating Device.
Japanese Patent Abstract No. 10–055092, date Feb. 24, 1998; Title: Image Forming Device.
Japanese Patent Abstract No. 10–186878 date Jul. 14, 1998; Title Image Forming Device.

* cited by examiner

*Primary Examiner*—Fred L. Braun
(74) *Attorney, Agent, or Firm*—Oblon, Spivak, McClelland, Maier & Neustadt, P.C.

(57) ABSTRACT

An image forming apparatus is provided with an image carrier that carries a visible image thereon, a transfer support element that conveys a sheet to which the visible image is transferred from the image carrier at a transfer nip portion, and a transfer member that applies a transfer bias to the transfer support element. The transfer member is in contact with an inner layer of the transfer support element at an edge of the transfer nip portion. The transfer member has a medium inherent volume resistance which is less than an inherent volume resistance of the inner layer of the transfer support element. Further, a plurality of transfer members may be provided, in which case the transfer member closest to the transfer nip portion has the medium inherent volume resistance.

47 Claims, 5 Drawing Sheets

IMAGE FORMING APPARATUS WITH A TRANSFER MEMBER HAVING AN INHERENT VOLUME RESISTANCE LESS THAN THAT OF AN INNER LAYER OF A TRANSPORT SUPPORT ELEMENT

BACKGROUND OF THE INVENTION

1. Field of the Invention

The present invention relates to an image forming apparatus including a transfer device, and more particularly relates to an image forming apparatus which enhances a transfer of an image with the transfer device.

2. Discussion of the Background

An image forming apparatus (e.g., a copier, facsimile, printer or similar image forming apparatus) is known to use a transfer system capable of transferring an image to a recording medium, e.g. a paper sheet, or which utilizes an intermediate transfer system. Such transfer systems have a transfer device, which contacts an image carrier, for transferring a toner image from the image carrier to the recording medium by applying a transfer bias voltage.

However, when utilizing such a transfer system it is possible that the transfer bias voltage may be improperly discharged (e.g., a leakage may occur) if the transfer device or the image carrier has pinholes, defects, or the like. Further, it is possible that the recording medium may be improperly transferred or an image forming may be improperly operated because of noise generated from the improper discharge.

Preventing such an improper discharge has been addressed. For example, Japanese Laid-Open Patent Publication No. 7-13440 discloses a transfer device having a transfer belt and plural electrodes for applying a transfer bias to the transfer belt. Japanese Laid-Open Patent Publication No. 8-152789 discloses a transfer device having a transfer belt and a transfer bias electrode that has at least a two-layer structure in order to prevent an improper discharge from the transfer belt to an image carrier. Japanese Laid-Open Patent Publication No. 9-73239 discloses a relation between a maximum applied voltage to an electrode and a shortest distance between a surface of the electrode and an image carrier in order to prevent an improper discharge from the transfer belt to the image carrier.

However, each of the solutions disclosed in the above-noted publications can only provide a limited solution to preventing the improper discharge. This is particularly the case since in recent years high-speed image forming apparatuses are starting to use a transfer system. In such high-speed image forming apparatuses, the amount of discharge for a unit area to be deposited on the transfer belt may be required to be increased if a process speed, including a moving speed of a transfer belt for forming a toner image, increases due to speeding up of the image forming operation, and as an applied voltage to the transfer belt increases. Thus, in such high-speed image forming apparatuses it becomes more likely that a transfer bias voltage may be improperly discharged (e.g., a leakage may occur). The solutions noted in the above background art may be inadequate to prevent an improper discharge under such conditions.

SUMMARY OF THE INVENTION

Accordingly, it is an object of the present invention to provide a novel transfer device which provides a stable image transferring under various conditions, including a high speed operation.

The present invention achieves these and other objects by providing an image forming apparatus which includes an image carrier configured to carry a visible image. A transfer support element is configured to contact the image carrier. A transfer member is configured to apply a transfer bias to the transfer support element. This transfer member is in contact with an inner layer of the transport support element. Further, the transfer member has a medium inherent volume resistance which is less than an inherent volume resistance of the inner layer of the transport support element.

As a further feature in the present invention which can achieve the above-noted and other objects, a plurality of transfer members may be configured to apply the transfer bias to the transfer support element. In this situation, a selected transfer member located at a nearest position to a transfer nip portion will have the highest inherent volume resistance of the plurality of transfer members.

As a further feature in the present invention, if the plurality of transfer members are utilized, an electrical resistance of a current flowing path between the nearest of the plurality of transfer members to the transfer nip portion may be less than the electric resistance of any current flowing path between the other plurality of transfer members and the transfer nip portion.

As a further feature in the present invention, when a plurality of transfer members are utilized, a contact pressure between a transfer member located nearest to the transfer nip portion and the transfer support element may be less than a contact pressure between any of the other of the plurality of transfer members and the transfer support element.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
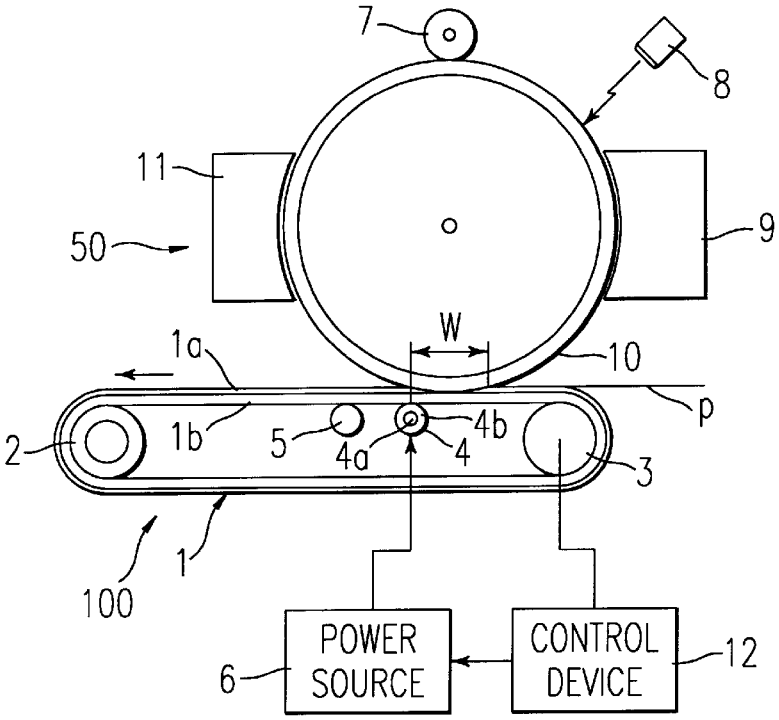
FIG. 1 is a schematic illustration showing a transfer device according to a first embodiment of the present invention.

The present invention is explained in detail hereinafter referring to the several figures, in which like reference numerals for identical or corresponding parts are used throughout the several figures.

FIG. 1 is a schematic illustration of an image forming apparatus 50 including a transfer device according to a first embodiment of the present invention. The image forming apparatus 50 includes an image carrier (e.g., a photoconductive drum 10). Arranged around the photoconductive drum 10 are various process devices including a charger 7, an optical writing device 8, a developing device 9, and a cleaning device 11. A transfer device 100 is provided with a transfer support element (e.g., a transfer belt 1), a drive roller 2, a driven roller 3, a transfer member (e.g., a transfer roller 4), a support member (e.g., a support roller 5), and a high-tension transfer power source 6. The driven roller 3 is connected to a control device 12.

The drive roller 2 and the driven roller 3 support the transfer belt 1. A motor (not shown) drives the drive roller 2 to rotate the transfer belt 1 counterclockwise (as indicated by an arrow in FIG. 1). The drive roller 2 is held in an electrical floating state and has a metal shaft and an elastic surface layer made of a rubber. The driven roller 3 is made of a conductive metal and detects a current flowing through the transfer belt 1, and feeds a detected current signal back to a control device 12 as a current feedback signal.

The transfer belt 1 has a double layer structure that is provided with an outer layer 1*a* having a preselected inherent volume resistance (e.g., $1\times10^9$ to $1\times10^{13}$ Ωcm) and an inner layer 1*b* having a preselected inherent volume resistance (e.g., $1\times10^7$ to $5\times10^9$ Ωcm). The transfer belt 1 thus has an overall preselected volume resistance (e.g., $1\times10^9$ to $5\times10^{11}$ Ωcm). The inherent volume resistance is determined by experiments based on JIS (Japanese Industrial Standards) K 6911. The inner layer 1*b* is formed of chloroprene rubber, EPDM rubber (ethylene-propylene copolymer), silicone rubber, epichloro rubber or a similar sparingly hygroscopic substance and carbon, zinc oxide, or a similar resistance control agent added thereto in an adequate amount for implementing a preselected inherent volume resistance. The outer layer 1*a* is coated to a thickness of 5 to 15 μm on the surface of the inner layer 1*b*. The outer layer 1*a* includes fluorine material (e.g., polyvinilidene fluoride, tetrafluoroethylene) or a similar lubricant material. Thus, the friction coefficient of the surface of the transfer belt 1 is low, and a cleaning can be stably performed on the outer layer 1*a*.

The support roller 5 is made of metal or a similar conductive material (e.g., stainless steel) and is held in an electrical floating state. The support roller 5 is located downstream of a transfer nip W, which is formed between the photoconductive drum 10 and the transfer belt 1, with respect to the moving direction of the transfer belt 1 by a preselected distance (e.g., 20 mm) and contacts a surface of the inner layer 1*b*. In this case, the support roller 5 is located downstream of the middle point of the transfer nip W by a preselected distance (e.g., 25 mm). Thus, the transfer nip W can be stably formed.

The transfer roller 4 is located between the transfer nip W and the support roller 5 and contacts the surface of the inner layer 1*b*. The transfer roller 4 has a shaft 4*a* and a covering layer 4*b* made of a medium inherent volume resistance material formed on the shaft 4*a*. The covering layer 4*b* is formed of a rubber material (e.g., urethane rubber, silicone rubber or ethylene-propylene copolymer rubber), a resin material (e.g., urethane resin), or a foam material (e.g., urethane foam) and carbon, zinc oxide, or a similar resistance control agent added thereto in an adequate amount for implementing a preselected inherent volume resistance. The covering layer 4*b* has a preselected medium inherent volume resistance (e.g., $1\times10^5$ to $5\times10^7$ Ωcm), a preselected thickness (e.g., 0.5 to 4.0 mm), and a preselected hardness (e.g., less than 50°, as measured by a rubber hardness tester Asker C).

The image forming operation of the device of FIG. 1 is now described. The optical writing device 8 uses a laser beam to scan the charged surface of the photoconductive drum 10, thereby forming an electrostatic latent image in accordance with image data on the photoconductive drum 10. The developing device 9 develops the latent image on the photoconductive drum 10, thus forming a visible image (e.g., a toner image) on the photoconductive drum 10. The transfer belt 1 transports a recording medium, e.g. paper sheet P, to the transfer nip W. The toner image is then transferred from the photoconductive drum 10 to the sheet P by a transfer bias applied via the transfer roller 4. The transfer bias is output from the power source 6 (e.g., between −1.5 kV and −6.5 kV). Assume that the current output from the power source 6 is I1, and that the current flowing from the driven roller 3 to the control device 12 via transfer belt 1 is I2. Then, the control device 12 controls the output of the power source 6 such that the following equation holds:

$$I1-I2=I_{out},$$

where $I_{out}$ is constant. When the above relation is satisfied, the transferring operation can be stably performed.

The inventors of the present invention performed experiments to determine a relation between the inherent volume resistance of the transfer roller 4 and a voltage applied from the power source 6 to the transfer belt 1 via the transfer roller 4 based on JIS (Japanese Industrial Standards) K 6911. Specifically, four different samples were prepared having transfer rollers 4 whose inherent volume resistances were respectively measured to be $1\times10^5$ Ωcm, $5\times10^6$ Ωcm, $1\times10^8$ Ωcm and $1\times10^9$ Ωcm. A position where the transfer roller 4 contacts the surface of the inner layer 1*b* was also varied in three steps for each of the samples. The experiments were conducted in a normal temperature (e.g., 25° C.) and normal humidity environment (e.g., 50%). The linear velocity was selected to be 540 mm/sec. The transfer width was selected to be 310 mm. The target value of the current was selected to be 90 μa. The inherent volume resistance of the inner layer 1*b* of the transfer belt 1 was selected to be $1\times10^9$ Ωcm (JIS K 6911). The thickness of the covering layer 4*b* of the transfer roller 4 was selected to be 2 mm. The hardness of the covering layer 4*b* of transfer roller 4 was selected to be 40° (measured by a rubber hardness tester Asker C). The distance between the support roller 5 and the outlet of the transfer nip W was selected to be 20 mm. The width of the transfer nip W was selected to be 10 mm. The thickness of the transfer belt 1 was selected to be 0.5 mm.

The voltage to the transfer roller 4 was measured as follows. A potential sensor (not shown) was placed in a position adjacent to the end of the shaft 4*a* of the transfer roller 4, and the potential sensor measured the applied voltage to the shaft 4*a* when the predetermined current was applied from the power source 6. An improper discharge between a surface of the outer layer 1*a* of the transfer belt 1 and a surface of the photoconductive drum 10 was visually evaluated by eye. The results of such experiments are listed in Table 1 in which circles and crosses indicate a "good (without the improper discharge)" result, and a "no good (an occurrence of the improper discharge)" result, respectively In Table 1 Va is the voltage that is applied from the power source 6 to the transfer belt 1 via the transfer roller 4, Rv is the inherent volume resistance of the transfer roller 4, and L is the distance between the transfer roller 4 and the outlet of the transfer nip W.

TABLE 1

| Rv (Ωcm) | Va (Kv) for L = 0 mm | Va (Kv) for L = 2 mm | Va (Kv) for L = 7 mm |
|---|---|---|---|
| $1 \times 10^5$ | 1.8 ○ | 2.8 ○ | 4.7 ○ |
| $5 \times 10^6$ | 2.4 ○ | 3.5 ○ | 6.9 ○ |
| $1 \times 10^8$ | 3.8 ○ | 5.0 ○ | 9.0 X |
| $1 \times 10^9$ | 5.5 ○ | 7.4 X | 10.0 X |

Further, a voltage to the support roller 5 was also measured in the same way in a structure of FIG. 1 without the transfer roller 4, and an improper discharge between the transfer belt 1 and the photoconductive drum 10 was visually evaluated by eye in order to provide a comparison with the results shown above in Table 1. In this structure without the transfer roller 4, the voltage to the support roller 5 increased and reached 10 kV or more, and an improper discharge occurred between the transfer belt 1 and the photoconductive drum 10. This example without the transfer roller 4 (which is not shown in Table 1) is referred to below as the "Comparative Example".

As Table 1 indicates, in the examples of Rv of $1\times10^5$ Ωcm, $5\times10^6$ Ωcm, and $1\times10^8$ Ωcm, the operations almost completely remain in an allowable level as to the improper discharge, i.e. almost no improper discharges occur. However, when the value of Rv is $1\times10^9$ Ωcm, improper discharges occur more significantly. From these experiments the inventors realized that when the transfer roller 4 has a medium inherent volume resistance which is less than that of the inner layer 1*b* of the transfer belt 1, a desirable result is achievable over a relatively broad operating range.

The above results are presumably because an electric resistance of a current flowing path between a point where the voltage is applied to the transfer roller 4 and the transfer nip W (as a point where the transfer belt 1 contacts the photoconductive drum 10) is less than that of a current flowing path between the support roller 5 and the transfer nip W. Namely, if the transfer roller 4 has a medium inherent volume resistance as noted above which is less than that of the inner layer 1*b,* the resistance of the current flowing path between the transfer roller 4 and the transfer nip W depends on a resistance of the transfer belt 1 corresponding to the length between a point where the transfer roller 4 contacts the transfer belt 1 and the transfer nip W.

As a result, the applied voltage to the transfer nip W via the transfer belt 1 is decreased as compared with the Comparative Example, and an improper discharge between the surface of the outer layer 1*a* and the photoconductive drum 10 can be reduced. Further, since the covering layer 4*b* of the transfer roller 4 has the medium inherent volume resistance, the improper discharge can also be reduced. In this embodiment, a desirable inherent volume resistance of covering layer 4*b* of the transfer roller 4 is $1\times10^5$ to $5\times10^7$ Ωcm and a desirable inherent volume resistance of the inner layer 1*b* of the transfer belt 1 is $1\times10^7$ to $5\times10^9$ Ωcm.

On the other hand, in the example of Rv of $1\times10^9$ Ωcm, the operation may be outside of an allowable level as to the improper discharge. Thus, when the inherent volume resistance of the transfer roller 4 is nearly the inherent volume resistance of the inner layer 1*b,* it is possible that the voltage may be insufficiently decreased as compared with the Comparative Example except for a transfer roller located at the transfer nip W (L=0 mm).

Accordingly, if the value of Rv is properly selected as noted above, as the power source 6 applies the voltage to the transfer roller 4, the transfer roller 4 efficiently deposits a charge on the transfer belt 1 even when the transfer voltage in the transfer nip W where the transfer belt 1 contacts the photoconductive drum 10 is low.

As a further drawback which can be overcome by the present invention, an improper high contact pressure between the transfer belt 1 and the photoconductive drum 10 may cause a toner image to be locally omitted when transferred to a sheet. To address this problem, and as a feature of the present invention, a contact pressure between the transfer roller 4 and the transfer belt 1 can be set to be less than a contact pressure between the support roller 5 and the transfer belt 1. Thus, the contact pressure between the transfer belt 1 and the photoconductive drum 10 is prevented from unsuitably increasing because the support roller 5 surely supports the transfer belt 1.

Figure 2:
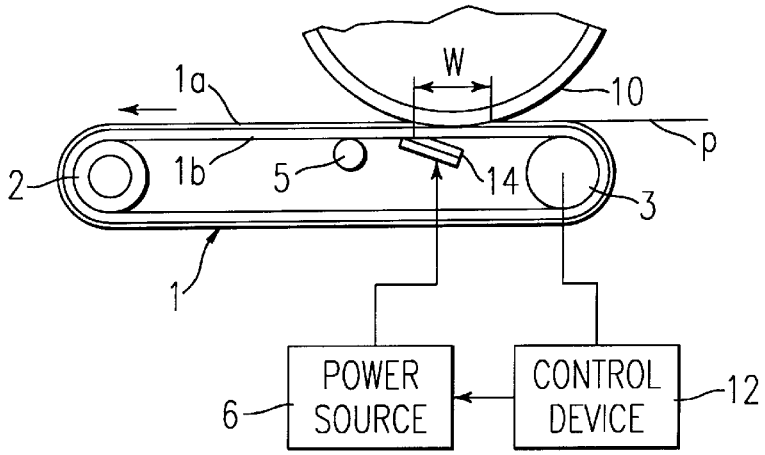
FIG. 2 is a schematic illustration showing a modification of the first embodiment of the present invention of FIG. 1.

FIG. 2 shows a modification of the embodiment of FIG. 1. This embodiment of FIG. 2 is similar to the embodiment of FIG. 1 except that a transfer brush 14 constitutes the transfer member, i.e a transfer brush 14 is used instead of the transfer roller 4. In FIG. 2, the same elements as in FIG. 1 are designated by the same reference numerals, and a detailed description thereof is not made in order to avoid redundancy.

The transfer brush 14 is located between the transfer nip W and the support roller 5, and contacts the surface of the inner layer 1*b* and has conductive filaments and a holder for supporting the filaments. The filaments are made of acrylic, nylon, polyester, polypropylene or similar materials and carbon, zinc oxide, or a similar resistance control agent added thereto in an adequate amount for implementing a preselected inherent volume resistance. Making an adjustment in a density of filaments, a length of filaments, or a thickness of filaments properly controls a contact pressure between the transfer brush 14 and the transfer belt 1. In this embodiment, a desirable inherent volume resistance of the transfer brush 14 is $1\times10^5$ to $5\times10^7$ Ωcm and a desirable length of the filaments of the transfer brush 14 is from 3.0 to 12.0 mm. By using such a transfer brush 14 the same results as in the above embodiment of FIG. 1 can be obtained. Utilizing the transfer brush 14 provides the further benefit that even if the surface of the inner layer 1*b* has unevenness, the transfer brush 14 can stably contact the surface of the inner layer 1*b* under a low contact pressure due to elasticity.

In the first embodiment of FIGS. 1 and 2, the transfer member has the medium inherent volume resistance which is less than that of the inner layer 1*b* of the transfer support element, and thus the applied voltage to the transfer nip portion can be decreased. Further, even if the image forming apparatus is a high-speed device, an improper discharge between the outer layer 1*a* of the transfer support element and the surface of the photoconductive element can be reduced. Furthermore, an occurrence of improper discharge can also be reduced by using a transfer member made of the medium inherent volume resistance material. Moreover, the contact pressure between the transfer support clement and the photoconductive drum can be low, and thereby improper image transferring can also be reduced.

In the first embodiment shown and described above in FIGS. 1 and 2, as examples of further modifications, the transfer belt 1 may be replaced with a transfer drum and the transfer belt 1 having a double layer structure may also be formed of a triple layer or more structure. The support roller 5 may also be replaced with a non-rotatable member (e.g., a plate, a pole, or the like) and may also be made of an insulating material or a medium inherent volume resistance material. The transfer roller 4 or the transfer brush 14 may be replaced with a transfer blade. The photoconductive drum 10 may be replaced with a photoconductive belt.

Figure 3:
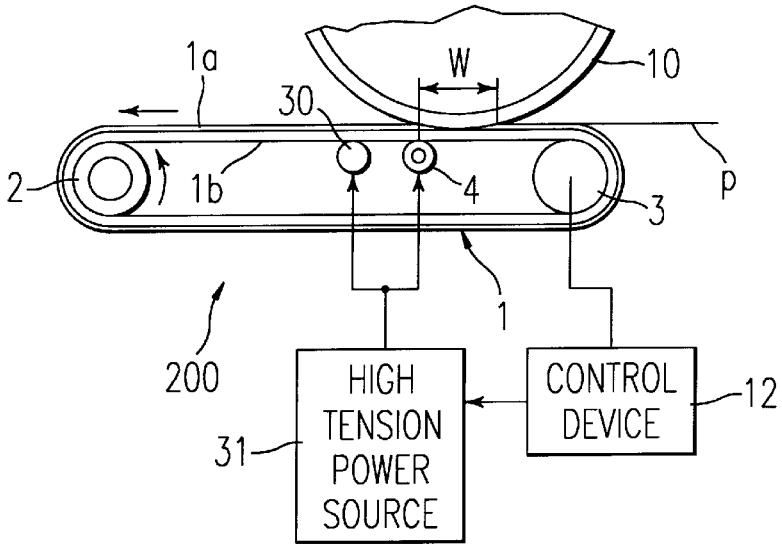
FIG. 3 is a schematic illustration showing a transfer device according to a second embodiment of the present invention.

A second embodiment of the present invention is now described with reference to FIGS. 3–5. FIG. 3 is a schematic illustration of a transfer device according to the second embodiment of the present invention. This embodiment is similar to the first embodiment of FIG. 1 except that a high-tension transfer power source 31 applies a transfer bias voltage to a support member. In FIG. 3, the same elements as in FIG. 1 are designated by the same reference numerals, and a detailed description thereof is not made in order to avoid redundancy.

In FIG. 3 a transfer device 200 is provided with a transfer support element (e.g., transfer belt 1), a drive roller 2, a driven roller 3, a transfer member (e.g., a transfer roller 4), a support member (e.g., a support roller 30), and a high-tension transfer power source 31. The transfer belt 1 has a double layer structure that is provided with an outer layer 1*a* having a preselected inherent volume resistance (e.g., $1\times10^{9}$ to $1\times10^{13}$ Ωcm) and an inner layer 1*b* having a preselected inherent volume resistance (e.g., $1\times10^{7}$ to $5\times10^{9}$ Ωcm). The support roller 30 is made of metal or a similar conductive material (e.g., stainless steel), and thus the inherent volume resistance of the support roller 30 is extremely low as compared with the inherent volume resistance of the transfer roller 4. The support roller 30 is located downstream of an outlet of a transfer nip W with respect to the moving direction of the transfer belt 1 by a preselected distance (e.g., 20 mm) and contacts a surface of the inner layer 1*b*. In this case, the support roller 30 is located downstream of the middle point of the transfer nip W by a preselected distance (e.g., 25 mm). Thus, the transfer nip W can be stably formed. The transfer roller 4 is located between the transfer nip W and the support roller 30 and contacts the surface of the inner layer 1*b*. The transfer roller 4 has a shaft 4*a* and a covering layer 4*b* made of a medium resistance material formed on the shaft 4*a*. The power source 31 applies a transfer bias voltage (e.g., between −1.5 kV and −6.5 kV) to the transfer roller 4 and the support roller 30. The control device 12 controls an output of the power source 31.

The inventors of this application performed experiments to determine relation between the inherent volume resistance of the transfer roller 4 and a voltage applied from the power source 31 to the transfer belt 1 via the transfer roller 4 and the support roller 30 based on JIS (Japanese Industrial Standards) K 6911. Specifically, four different samples were prepared having transfer rollers 4 whose inherent volume resistances were respectively measured to be $1\times10^{5}$ Ωcm, $5\times10^{6}$ Ωcm, $5\times10^{7}$ Ωcm, and $1\times10^{8}$ Ωcm (JIS K 6911) and four different samples having the inner layer 1*b* of the transfer belt 1 whose inherent volume resistances were respectively measured to be $1\times10^{7}$ Ωcm, $1\times10^{8}$ Ωcm, $1\times10^{9}$ Ωcm, and $5\times10^{9}$ Ωcm (JIS K 6911). A position where the transfer roller 4 contacts the surface of the inner layer 1*b* was varied in three steps for each of the samples. The experiments were conducted in a normal temperature (e.g., 25° C.) and normal humidity environment (e.g., 50%). The linear velocity was selected to be 540 mm/sec. The transfer width was selected to be 310 mm. The target value of the current was selected to be 90 μa. The thickness of the covering layer 4*b* of the transfer roller 4 was selected to be 2 mm. The hardness of the covering layer 4*b* of transfer roller 4 was selected to be 40° (measured by a rubber hardness tester Asker C). The distance between the support roller 5 and the outlet of the transfer nip W was selected to be 20 mm. The width of the transfer nip W was selected to be 10 mm. The thickness of the transfer belt 1 was selected to be 0.5 mm. The voltage to the transfer roller 4 was measured in the same way as in the first embodiment. The results of such experiments are shown in Table 2 to Table 5 in which circles and crosses respectively indicate a "good (without the improper discharge)" result, and a "no good (an occurrence of the improper discharge)" result.

In Table 2–Table 5 Va is the voltage that is applied from the power source 31 to the transfer belt 1 via the transfer roller 4, Rv is the inherent volume resistance of the transfer roller 4, and L is the distance between the transfer roller 4 and the outlet of the transfer nip W.

TABLE 2

| | The inherent volume resistance of the inner layer 1b of the transfer belt 1 was selected to be $1\times10^{7}$Ωcm (JIS K 6911) | | | | | | |
|---|---|---|---|---|---|---|---|
| Rv (Ωcm) | Va (Kv) for L = 0 mm | Va (Kv) for L = 2 mm | Va (Kv) for L = 5 mm | Va (Kv) for L = 6 mm | Va (Kv) for L = 7 mm | Va (Kv) for L = 8 mm | Va (Kv) for L = 9 mm |
| $1\times10^{5}$ | 1.0 | 1.4 | 2.0 | 2.4 | 2.7 | 3.0 | 3.3 |
| | ○ | ○ | ○ | ○ | ○ | ○ | ○ |
| $5\times10^{6}$ | 1.4 | 1.8 | 3.7 | 4.2 | 4.6 | 4.9 | 5.2 |
| | ○ | ○ | ○ | ○ | ○ | ○ | ○ |
| $5\times10^{7}$ | 2.0 | 2.6 | 5.3 | 5.8 | 6.3 | 6.6 | 6.8 |
| | ○ | ○ | ○ | ○ | ○ | ○ | X |
| $1\times10^{8}$ | 2.4 | 3.3 | 6.0 | 6.3 | 7.1 | 7.3 | 7.5 |
| | ○ | ○ | ○ | X | X | X | X |

TABLE 3

| Rv (Ωcm) | Va (Kv) for L = 0 mm | Va (Kv) for L = 2 mm | Va (Kv) for L = 5 mm | Va (Kv) for L = 6 mm | Va (Kv) for L = 7 mm | Va (Kv) for L = 8 mm | Va (Kv) for L = 9 mm |
|---|---|---|---|---|---|---|---|
| The inherent volume resistance of the inner layer 1b of the transfer belt 1 was selected to be $1 \times 10^8$Ωcm (JIS K 6911) | | | | | | | |
| $1 \times 10^5$ | 1.3 ○ | 1.8 ○ | 2.7 ○ | 3.2 ○ | 3.4 ○ | 3.6 ○ | 3.7 ○ |
| $5 \times 10^6$ | 1.9 ○ | 2.5 ○ | 4.5 ○ | 4.9 ○ | 5.2 ○ | 5.5 ○ | 5.7 ○ |
| $5 \times 10^7$ | 2.6 ○ | 3.3 ○ | 6.1 ○ | 6.4 ○ | 6.7 ○ | 6.9 ○ | 7.0 X |
| $1 \times 10^8$ | 3.0 ○ | 3.8 ○ | 6.6 ○ | 7.0 X | 7.4 X | 7.7 X | 8.0 X |

TABLE 4

| Rv (Ωcm) | Va (Kv) for L = 0 mm | Va (Kv) for L = 2 mm | Va (Kv) for L = 5 mm | Va (Kv) for L = 6 mm | Va (Kv) for L = 7 mm | Va (Kv) for L = 8 mm | Va (Kv) for L = 9 mm |
|---|---|---|---|---|---|---|---|
| The inherent volume resistance of the inner layer 1b of the transfer belt 1 was selected to be $1 \times 10^9$Ωcm (JISK6911) | | | | | | | |
| $1 \times 10^5$ | 1.8 ○ | 2.8 ○ | 3.9 ○ | 4.2 ○ | 4.5 ○ | 4.7 ○ | 4.8 ○ |
| $5 \times 10^6$ | 2.5 ○ | 3.3 ○ | 5.6 ○ | 6.0 ○ | 6.5 ○ | 6.7 ○ | 6.9 ○ |
| $5 \times 10^7$ | 3.2 ○ | 4.0 ○ | 6.7 ○ | 7.1 ○ | 7.5 ○ | 7.7 ○ | 7.9 X |
| $1 \times 10^8$ | 3.7 ○ | 4.5 ○ | 7.3 ○ | 7.8 X | 8.3 X | 8.5 X | 8.7 X |

TABLE 5

| Rv (Ωcm) | Va (Kv) for L = 0 mm | Va (Kv) for L = 2 mm | Va (Kv) for L = 5 mm | Va (Kv) for L = 6 mm | Va (Kv) for L = 7 mm | Va (Kv) for L = 8 mm | Va (Kv) for L = 9 mm |
|---|---|---|---|---|---|---|---|
| The inherent volume resistance of the inner layer 1b of the transfer belt 1 was selected to be $5 \times 10^9$Ωcm (JIS K 6911) | | | | | | | |
| $1 \times 10^5$ | 2.1 ○ | 3.0 ○ | 4.1 ○ | 4.3 ○ | 4.7 ○ | 4.9 ○ | 5.0 ○ |
| $5 \times 10^6$ | 2.8 ○ | 3.5 ○ | 5.8 ○ | 6.2 ○ | 6.8 ○ | 7.0 ○ | 7.1 ○ |
| $5 \times 10^7$ | 3.5 ○ | 4.2 ○ | 6.9 ○ | 7.3 ○ | 7.8 ○ | 8.0 ○ | 8.1 X |
| $1 \times 10^8$ | 4.0 ○ | 4.8 ○ | 7.5 ○ | 8.0 X | 8.7 X | 8.9 X | 9.1 X |

Further, a voltage to the support roller 30 was also measured in a structure without the transfer roller 4, and an improper discharge between the transfer belt 1 and the photoconductive drum 10 was visually evaluated by eye in order to provide a comparison with the results of the experiments as shown in Table 2–Table 5. In this structure without the transfer roller 4, the voltage to the support roller 30 increased and reached the 10 kV or more, and an improper discharge occurred between the transfer belt 1 and the photoconductive drum 10. Thus, utilizing the transfer roller 4 prevented such an improper discharge. This example again without the transfer roller 4 is referred to below as the "Comparative Example".

As Table 2 to Table 5 indicate, in the examples of Rv of $1\times10^5$ Ωcm, $5\times10^6$ Ωcm, and $5\times10^7$ Ωcm, the operation almost completely remains in the allowable level as to the improper discharge, i.e. almost no improper discharge occurs. However, when the value of Rv is $1\times10^8$ Ωcm, improper discharges occur more significantly. From these experiments the inventors realized that when the transfer roller 4 has a medium inherent volume resistance which is less than that of the inner layer 1*b* of the transfer belt 1, a desirable result is achievable over a relatively broad operation range.

The above results are presumably because an electric resistance of a current flowing path between the point where the voltage is applied to the transfer roller 4 and the transfer nip W as the point where the transfer belt 1 contacts the photoconductive drum 10 is less than that of a current flowing path between the support roller 30 and the transfer nip W. Namely, if the transfer roller 4 has a medium inherent volume resistance which is less than an inherent volume resistance of the inner layer 1*b,* the resistance of the current flowing path between the transfer roller 4 and the transfer nip W depends on a resistance of the transfer belt 1 corresponding to the length between a point where the transfer roller 4 contacts the transfer belt 1 and the transfer nip W.

As a result, the applied voltage to the transfer nip W via the transfer belt 1 is decreased as compared with the Comparative Example, and the improper discharge between the surface of the outer layer 1*a* and the photoconductive drum 10 can be reduced. In this embodiment, a desirable inherent volume resistance of covering layer 4*b* of the transfer roller 4 is $1\times10^5$ to $5\times10^7$ Ωcm and a desirable inherent volume resistant of the inner layer 1*b* of the transfer belt 1 is $1\times10^7$ to $5\times10^9$ Ωcm.

On the other hand, in the example of Rv of $1\times10^8$ Ωcm, the operation may be outside of an allowable level as to the improper discharge. Thus, when the inherent volume resistance of the transfer roller 4 is nearly the inherent volume resistance of the inner layer 1*b,* it is possible that the voltage may be insufficiently decreased as compared with the Comparative Example except for a transfer roller 4 located at the transfer nip W (L=0 mm).

In the second embodiment, the transfer device 200 has two electrodes, the transfer roller 4 and the support roller 30, for applying a transfer bias voltage to the transfer belt 1. The use of two such electrodes provides a benefit that even if an abnormality occurs in the transfer roller 4, the operation of an image transferring can temporarily continue for a period of time because the support roller 30 as a transfer member can still apply the transfer bias voltage to the transfer belt 1. Further, it is desirable that the electrode located at the nearest portion (including directly below the transfer nip) to the transfer nip W has the highest inherent volume resistance (the inherent volume resistance between a point where the voltage is applied to the electrode and a point where the electrode contacts the transfer belt 1) of the electrodes. In the second embodiment, the inherent volume resistance of the support roller 30 made of metal is extremely low as compared with the inherent volume resistance of the transfer roller 4. In other words, the inherent volume resistance of the transfer roller 4 is set to be higher than that of the support roller 30. As a result, the applied voltage to the transfer nip W via the transfer belt 1 is decreased as compared with the Comparative Example, and an improper discharge between the surface of the outer layer 1*a* and the photoconductive drum 10 can be reduced. Further, if the covering layer 4*b* of the transfer roller 4 has a medium inherent volume resistance, the improper discharge can also be reduced.

Accordingly, in the second embodiment, as the power source 31 applies a voltage to the transfer roller 4, the transfer roller 4 efficiently deposits a charge on the transfer belt 1 even when the transfer voltage in the transfer nip W where the belt 1 contacts the photoconductive drum 10 is low.

As a further drawback which can be overcome by the present invention, an improper high contact pressure between the transfer belt 1 and the photoconductive drum 10 may cause a toner image to be locally omitted when transferred to a sheet. To address this problem, in the embodiment of FIG. 3, a contact pressure between the transfer roller 4 and the transfer belt 1 can be set to be less than a contact pressure between the support roller 30 and the transfer belt 1. Thus, the contact pressure between the transfer belt 1 and the photoconductive drum 10 is prevented from unsuitably increasing because the support roller 30 surely supports the transfer belt 1.

Figure 4:
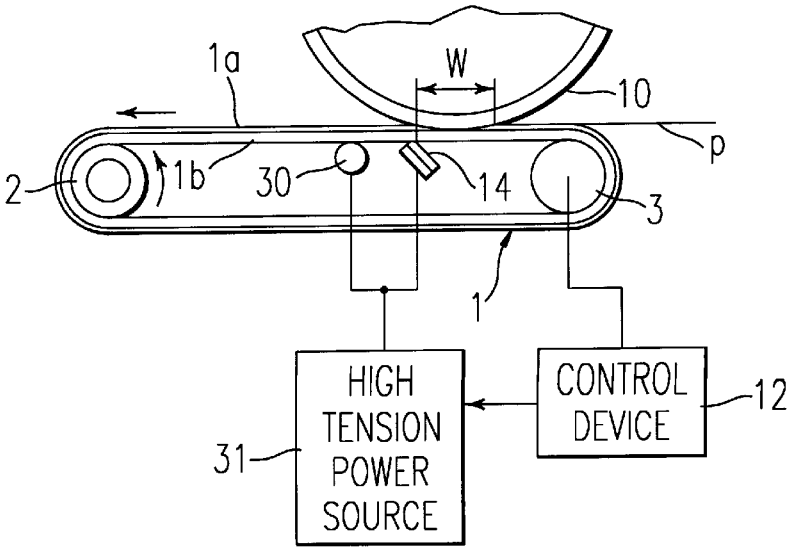
FIG. 4 is a schematic illustration showing a first modification of the second embodiment of the present invention of FIG. 2.

FIG. 4 shows a first modification of the second embodiment of FIG. 3. This embodiment of FIG. 4 is similar to the embodiment of FIG. 3 except that a transfer brush 14, which has the same structure as the transfer brush of the first embodiment of FIG. 2, constitutes the transfer member, i.e. the transfer brush 14 is used instead of the transfer roller 4. In FIG. 4, the same elements as in FIG. 3 are designated by the same reference numerals, and a detailed description thereof is not made in order to avoid redundancy.

The transfer brush 14 is located between the transfer nip W and the support roller 30. The transfer brush 14 contacts the surface of the inner layer 1*b* and has conductive filaments and a holder for supporting the filaments.

Utilizing the transfer brush 14 provides the further benefit that even if the surface of the rear layer 1*b* has unevenness, the transfer brush 14 can stably contact the surface under a low contact pressure due to elasticity. Further, even if an abnormality occurs in the transfer brush 14, the operation of an image transferring can temporarily continue for a period of time because the support roller 30 as a transfer member can still apply the transfer bias voltage to the transfer belt 1. Therefore, this first modification of the second embodiment using the transfer brush 14 can obtain the same results as the first and the second embodiments.

Figure 5:
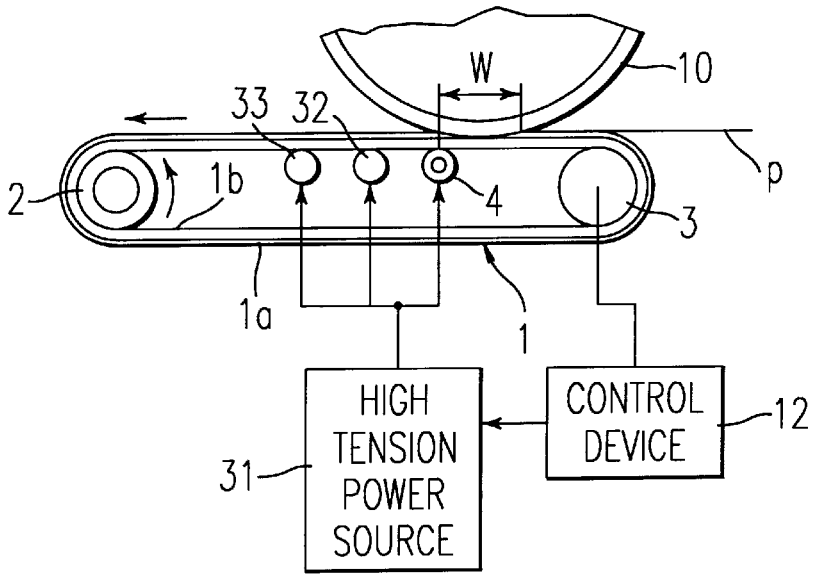
FIG. 5 is a schematic illustration showing a second modification of the second embodiment of the present invention of FIG. 2.

FIG. 5 shows a second modification of the second embodiment of FIG. 3. This embodiment of FIG. 5 is similar to the second embodiment of FIG. 3 except that two support rollers 32 and 33 constitute the support member. In FIG. 5, the same elements as in FIG. 3 are designated by the same reference numerals, and a detailed description thereof is not made in order to avoid redundancy.

The support rollers 32 and 33 are each made of metal or a similar conductive material (e.g., stainless steel). The support rollers 32, 33 are located between the transfer roller 4 and the drive roller 2 and contact a surface of the inner layer 1*b*. Thus, the transfer nip W can be stably formed. The power source 31 applies a transfer bias voltage (e.g., between −1.5 kV and −6.5 kV) to the transfer roller 4, and the support rollers 32 and 33. The control device 12 controls an output of the power source 31. The second modification of the second embodiment using the support rollers 32 and 33 can obtain the same results as the first and the second embodiments.

In the second embodiment of FIGS. 3–5, the transfer member has a medium inherent volume resistance which is less than that of the inner layer 1*b* of the transfer support element, and thus the applied voltage to the transfer nip portion can be decreased. Further, even if the image forming apparatus is a high-speed device, improper discharge between the outer layer 1*a* of the transfer support element and the surface of the photoconductive element can be reduced. Furthermore, an occurrence of improper discharge can also be reduced by using a transfer member made of a medium inherent volume resistance material. Moreover, the contact pressure between the transfer support element and the drum can be low, and improper image transferring can thereby be reduced.

In the second embodiments shown and described in FIGS. 3–5 several further modifications are possible, for example the transfer belt 1 may be replaced with a transfer drum. The transfer belt 1 having a double layer structure may also be formed of a triple layer or more structure. The support roller 30 may also be replaced with a non-rotatable member (e.g., a plate, a pole or the like) and may be made of an insulating material or a medium inherent volume resistance material. The transfer roller 4 or the transfer brush 14 may also be replaced with a transfer blade. The photoconductive drum 10 may also be replaced with a photoconductive belt.

Figure 6:
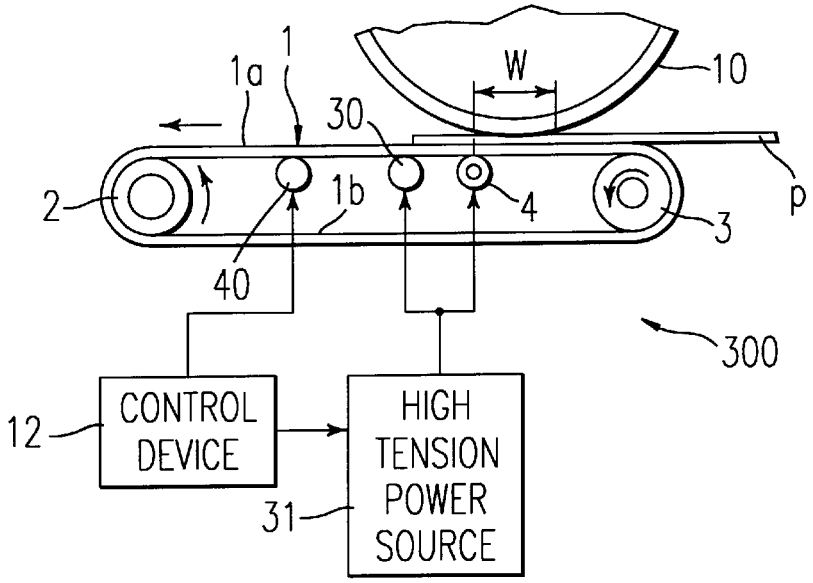
FIG. 6 is a schematic illustration showing a transfer device according to a third embodiment of the present invention.

A third embodiment of the present invention is now described with reference to FIGS. 6–8. FIG. 6 is a schematic illustration of a transfer device 300 according to the third embodiment of the present invention. This embodiment is similar to the second embodiment of FIG. 3 except that a relation of contact pressures, with the transfer roller 4 and the support roller 30 contacting the transfer belt 1, is clarified and the current flows from a feedback member 40 to the control device 12 via the transfer belt 1. In FIG. 6, the same elements as shown in FIG. 3 are designated by the same reference numerals, and a detailed description thereof is not made in order to avoid redundancy.

In FIG. 6 the transfer roller 4 is located at a preselected position, e.g., directly below the transfer nip W to downstream of the outlet of the transfer nip W with respect to the moving direction of the transfer belt 1 by 10 mm. The support roller 30 is located downstream of the outlet of the transfer nip W with respect to the moving direction of the transfer belt 1 by a preselected position (e.g., 20 mm). The rollers 4, 30 each contact the surface of the inner layer 1*b* under preselected contact pressures. The feedback member (e.g., the feedback roller 40) is made of metal or a similar conductive material (e.g., stainless steel) and is located downstream of the support roller 30 with respect to the moving direction of the transfer belt 1. The power source 31 applies a transfer bias voltage (e.g., between −1.5 kV and −6.5 kV) to the transfer roller 4 and support roller 30. The current flows from the feedback roller 40 to the control device 12 via the transfer belt 1 as a feedback current signal, and the control device 12 controls an output of the power source 31 based on the feedback current signal.

The present invention of FIG. 6 can overcome a problem that an improper high contact pressure between the transfer belt 1 and the photoconductive drum 10 may cause a toner image to be locally omitted (a so-called transfer hollow) when transferred to a sheet. This is presumably because toner cohered with other toner causes a high contact pressure to remain on the photoconductive drum 10.

The inventors of the present application determined by experiments a relation between the contact pressure and the transfer hollow. As a result, it was determined that when the contact pressure between the transfer roller 4 and the transfer belt 1 is less than the contact pressure between the support roller 30 and the transfer belt 1, the transfer hollow can be reduced. In this embodiment, a desirable contact pressure between the transfer roller 4 and the transfer belt 1 is 1 g/cm to 4 g/cm (gram per centimeter) and a desirable contact pressure between the support roller 30 and the transfer belt 1 is 5 g/cm to 20 g/cm (gram per centimeter). Further enhanced operations can be achieved if the contact pressure between the transfer roller 4 and the transfer belt 1 is 2 g/cm to 3 g/cm and if the contact pressure between the support roller 30 and the transfer belt 1 is 6 g/cm to 12 g/cm.

Further, the third embodiment of FIG. 6 can obtain the same results as the first and the second embodiments.

Figure 7:
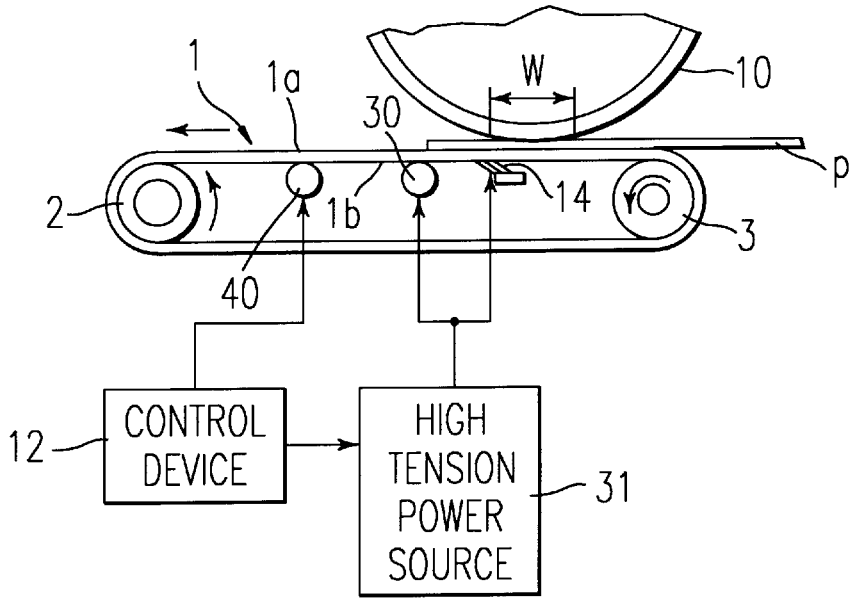
FIG. 7 is a schematic illustration showing a first modification of the third embodiment of the present invention of FIG. 6.

FIG. 7 shows a first modification of the third embodiment of FIG. 6. This embodiment of FIG. 7 is similar to the third embodiment of FIG. 6 except that a transfer brush 14, which has the same structure as the transfer brush of the first embodiment of FIG. 2, constitutes the transfer member, i.e. the transfer brush 14 is used instead of the transfer roller 4. In FIG. 7, the same elements as shown in FIG. 6 are designated by the same reference numerals, and a detailed description thereof is not made in order to avoid redundancy.

The transfer brush 14 is located between the transfer nip W and the support roller 30, and the transfer brush 14 contacts the surface of the inner layer 1*b* and has conductive filaments and a holder for supporting the filaments. In this embodiment, when the contact pressure between the transfer brush 14 and the transfer belt 1 is less than the contact pressure between the support roller 30 and the transfer belt 1, the transfer hollow can be reduced.

Utilizing the transfer brush 14 provides the further benefit that even if the surface of the inner layer 1*b* has unevenness, the transfer brush 14 can stably contact the surface under a low contact pressure due to elasticity. Moreover, even if an abnormality occurs in the transfer brush 14, the operation of an image transferring can temporarily continue for a period of time because the support roller 30 as a transfer member still applies the transfer bias voltage to the transfer belt 1. Therefore, this first modification of the third embodiment using the transfer brush 14 can obtain the same results as the first, the second, and the third embodiments.

Figure 8:
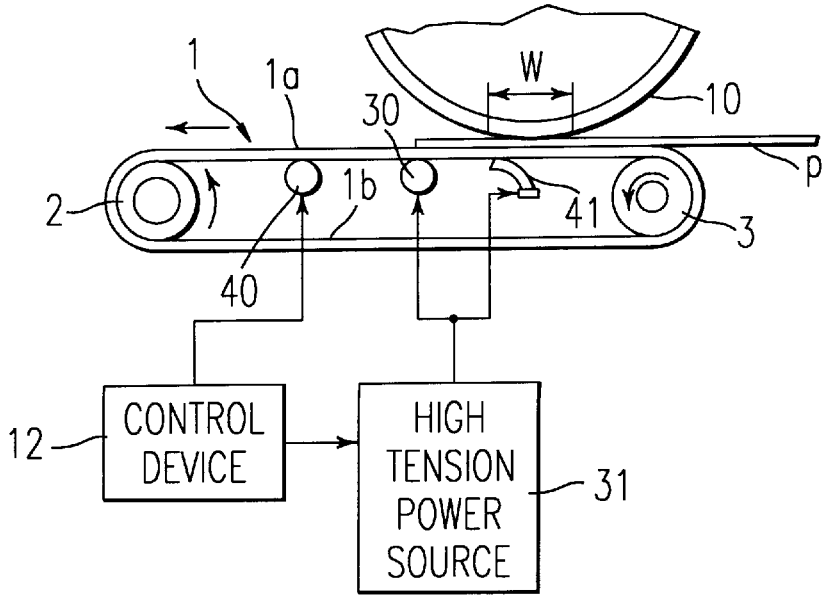
FIG. 8 is a schematic illustration showing a second modification of the third embodiment of the present invention of FIG. 6.

FIG. 8 shows a second modification of the third embodiment. This embodiment of FIG. 8 is similar to the third embodiment of FIG. 6 except that a transfer blade 41 is utilized instead of a transfer roller or transfer brush. In FIG. 8, the same elements as shown in FIG. 6 are designated by the same reference numerals, and a detailed description thereof is not made in order to avoid redundancy.

The transfer blade 41 is made of a conductive elastic body (e.g., a conductive rubber or resin). The transfer blade 41 is located between the transfer nip W and the support roller 30 and contacts the surface of the inner layer 1*b* under a preselected contact pressure. The power source 31 applies a transfer bias voltage (e.g., between −1.5 kV and −6.5 kV) to the transfer blade 41 and the support roller 30. A feedback current flows from the feedback roller 40 to the control device 12 via the transfer belt 1, and the control device 12 controls an output of the power source 31 based on the feedback current. In the embodiment of FIG. 8, when the contact pressure between the transfer brade 41 and the transfer belt 1 is less than the contact pressure between the support roller 30 and the transfer belt 1, the transfer hollow can be reduced.

Further, even if an abnormality occurs in the transfer blade 41, the operation of an image transferring can temporarily continue for a period of time because the support roller 30 as a transfer member still applies the transfer bias voltage to the transfer belt 1. Therefore, this second modification of the third embodiment using the transfer blade 41 can obtain the same results as the first, the second, and the third embodiments.

Figure 9:
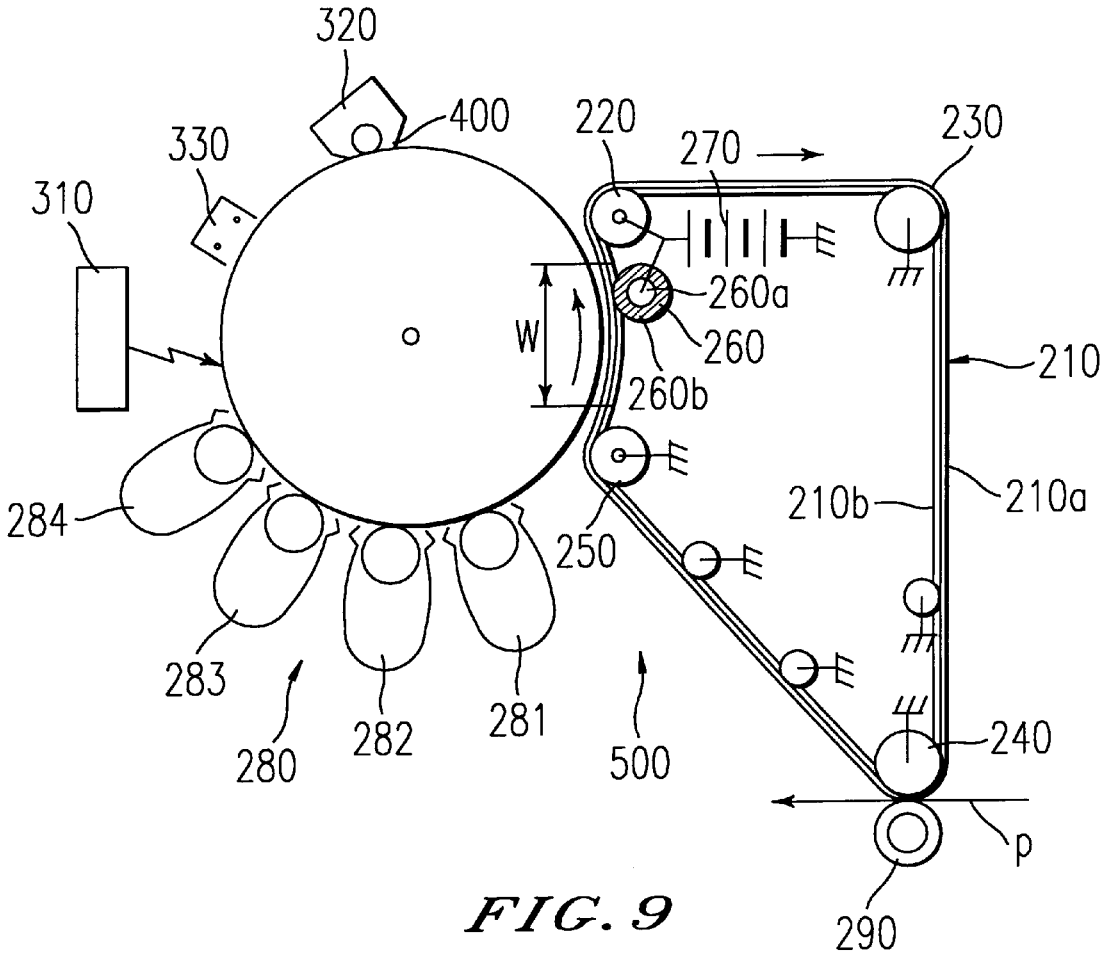
FIG. 9 is a schematic illustration showing a transfer device according to a fourth embodiment of the present invention.

FIG. 9 is a schematic illustration of a transfer device according to a third embodiment of the present invention. An image forming apparatus using an intermediate transfer medium embodying the present invention is shown in FIG. 9. The image forming apparatus has an image carrier (e.g., a photoconductive drum 200). Arranged around the photoconductive drum 400 are various process devices including a charger 330, an optical writing device 310, a developing device 280 having units 281–284, a cleaning device 320, and an intermediate transfer device 500.

The intermediate transfer device 500 is provided with an intermediate transfer support element (e.g., an intermediate transfer belt 210), a drive roller 240, a driven roller 230, a ground member (e.g., a ground roller 250), a transfer member (e.g., a transfer roller 260), a support member (e.g., a support roller 220), a sheet transfer member (e.g., a sheet transfer roller 290), and a high-tension transfer power source 270.

The drive roller 240, the driven roller 230, the ground roller 250, the support roller 220, and the transfer roller 260 support the intermediate transfer belt 210. A motor (not shown) drives the drive roller 240 to rotate the intermediate transfer belt 210 clockwise (as indicated by an arrow in FIG. 9). The rollers 220 and 250 strain the intermediate transfer belt 210. Thus the intermediate transfer belt 210 contacts the photoconductive drum 400, and a transfer nip W is formed between the intermediate transfer belt 210 and the photoconductive drum 400. The intermediate transfer belt 210 has a double layer structure that is provided with an outer layer 210*a* having a preselected inherent volume resistance (e.g., $1\times10^9$ to $1\times10^{13}$ Ωcm) and an inner layer 210*b* having a preselected inherent volume resistance (e.g., $1\times10^7$ to $5\times10^9$ Ωcm). The intermediate transfer belt 210 thus has an overall preselected volume resistance (e.g., $1\times10^9$ to $5\times10^{11}$ Ωcm). The inherent volume resistance is determined by experiments based on JIS (Japanese Industrial Standards) K 6911.

The transfer roller 260 is located between the transfer nip W and the support roller 220. The transfer roller 260 has a shaft 260*a* and a covering layer 260*b* made of a medium inherent volume resistance material formed on the shaft 260*a*. The covering layer 260*b* has a preselected inherent volume resistance (e.g., $1\times10^5$ to $5\times10^7$ Ωcm). The support roller 220 is made of metal or a similar conductive material (e.g., stainless steel). The support roller 220 is located downstream of the transfer nip W with respect to the moving direction of the intermediate transfer belt 210 and contacts the inner layer 210*b* of the intermediate transfer belt 210. The power source 270 applies a primary transfer bias voltage to the transfer roller 260 and the support roller 220. The drive roller 240 faces the sheet transfer roller 290 via the intermediate transfer belt 210 and functions as a facing electrode for forming an electric field. A power source (not shown) applies a secondary transfer bias voltage to the sheet transfer roller 290.

The image forming operation for this embodiment of FIG. 9 is now described. The charger 330 charges the surface of the photoconductive drum 400. The optical writing device 310 sequentially writes images on the photoconductive drum 400 in accordance with image data representative of images of particular colors. Developing units 281–284 each develop a latent image of a particular color electrostatically formed on the photoconductive drum 400 by the optical writing device 310. An electric field formed by the transfer roller 260 and the support roller 220 sequentially transfers toner images sequentially formed on the photoconductive drum 400 by the developing device 280 to the intermediate transfer belt 210 one above the other (a primary transfer). The sheet transfer roller 290 then collectively transfers a color toner image from the intermediate transfer belt 210 to a sheet P (a secondary transfer).

In this embodiment of FIG. 9, it is preferable that the transfer roller 260 has a medium inherent volume resistance which is less than the inherent volume resistance of the inner layer 210*b* of the intermediate transfer belt 210. As a result, a resistance of a current flowing path from the power source 270 to the transfer nip W via the transfer roller 260 can be less than that via the support roller 220, and an improper discharge between the intermediate transfer belt 210 and the photoconductive drum 400 can be reduced. A desirable inherent volume resistance of covering layer 260*b* of the transfer roller 260 is $1\times10^5$ to $5\times10^7$ Ωcm and a desirable inherent volume resistance of the inner layer 210*b* of the intermediate transfer belt 210 is $1\times10^7$ to $5\times10^9$ Ωcm.

Accordingly, even if the image forming apparatus is a high-speed device, the transfer voltage in the transfer nip W where the intermediate transfer belt 210 contacts the photoconductive drum 400 can be reduced and the transfer roller 260 can efficiently deposit a charge on the intermediate transfer belt 210. Further, even if an abnormality occurs in the transfer roller 260, the operation of an image transferring can temporarily continue for a period of time because the support roller 220 as a transfer member can still apply the transfer bias voltage to the intermediate transfer belt 210. Further, an occurrence of improper discharge between the intermediate transfer belt 210 and the photoconductive drum 400 can be reduced.

In the fourth embodiment shown and described in FIG. 9, the sheet transfer roller 290 (the secondary transfer) may be replaced with the transfer belt 1 having the transfer roller 4 or the transfer roller 260. The intermediate transfer belt 210 may be replaced with an intermediate transfer drum or an intermediate transfer roller. Moreover, the fourth embodiment can obtain the same results as the first, the second, and the third embodiment.

The above-mentioned illustrative embodiments have been explained with values of resistances, contact pressures, a structure and an arrangement of the transfer belt, the intermediate transfer belt, the transfer roller, the support roller, etc. These illustrative embodiments, however, are not intended to be limiting and may be altered to match other image forming conditions.

Obviously, numerous additional modifications and variations of the present invention are possible in light of the above teachings. It is therefore to be understood that within the scope of the appended claims, the present invention may be practiced otherwise than as specifically described herein.

The present document is based on Japanese Priority Documents 10-48626, 10-63489, and 10-64279 filed in the Japanese Patent Office, the entire contents of which are incorporated herein by reference.

What is claimed is:

1. An image forming apparatus comprising:

an image carrier configured to carry a visible image thereon;

a transfer support element configured to contact said image carrier at a transfer nip portion;

a transfer member configured to apply a transfer bias to said transfer support element, said transfer member contacting an inner layer of said transfer support element at an edge of the transfer nip portion; and wherein said transfer member has a medium inherent volume resistance which is less than an inherent volume resistance of said inner layer of said transport support element.

2. An image forming apparatus as claimed in claim 1, wherein said inherent volume resistance of said transfer member is greater than $1\times10^5$ Ωcm inclusive, and is less than $1\times10^9$ Ωcm.

3. An image forming apparatus as claimed in claim 1, wherein said inherent volume resistance of said inner layer of said transfer support element is greater than $1\times10^7$ Ωcm inclusive, and is less than $5\times10^9$ Ωcm.

4. An image forming apparatus as claimed in claim 3, wherein said inherent volume resistance of an outer layer of said transfer support element is greater than $1\times10^9$ Ωcm inclusive, and is less than $1\times10^{13}$ Ωcm.

5. An image forming apparatus as claimed in claim 1, wherein said transfer member is located below or downstream of said transfer nip portion where said transfer support element is in contact with said image carrier with respect to a moving direction of said transfer support element.

6. An image forming apparatus as claimed in claim 1, further comprising a support member configured to contact said inner layer of said transfer support element, said support member located downstream of said transfer member with respect to a moving direction of said transfer support element.

7. An image forming apparatus as claimed in claim 6, wherein a contact pressure between said transfer member and said transfer support element is less than a contact pressure between said support member and said transfer support element.

8. An image forming apparatus as claimed in claim 6, wherein said support member is configured to apply said transfer bias to said transfer support element.

9. An image forming apparatus as claimed in claim 1, wherein said transfer member comprises one element selected from the group consisting of a transfer roller, a transfer brush, and a transfer blade.

10. An image forming apparatus as claimed in claim 1, wherein said transfer support element comprises a transfer belt.

11. An image forming apparatus as claimed in claim 1, wherein said image carrier comprises a photoconductive belt.

12. An image forming apparatus as claimed in claim 1, wherein said transfer support element comprises an intermediate transfer belt.

13. An image forming apparatus as claimed in claim 1, wherein the transfer support element is an intermediate transfer belt onto which an image is transferred from said image carrier.

14. An image forming apparatus comprising:

an image carrier configured to carry a visible image thereon;

a transfer support clement configured to contact said image carrier at a transfer nip portion;

a plurality of transfer members configured to apply a transfer bias to said transfer support element, said plurality of transfer members contacting an inner layer of said transfer support element;

wherein a nearest transfer member located at a nearest position to said transfer nip portion has a highest inherent volume resistance of all of said plurality of transfer members.

15. An image forming apparatus as claimed in claim 14, wherein said inherent volume resistance corresponds to an inherent volume resistance between a point where said transfer bias is applied to said transfer support element and a point where said transfer support element is in contact with said nearest transfer member.

16. An image forming apparatus as claimed in claim 14, wherein said inherent volume resistance of said nearest transfer member is greater than $1\times10^5$ Ωcm inclusive, and is less than $1\times10^9$ Ωcm.

17. An image forming apparatus as claimed in claim 14, wherein said inherent volume resistance of said inner layer of said transfer support element is greater than $1\times10^7$ Ωcm inclusive, and is less than $5\times10^9$ Ωcm.

18. An image forming apparatus as claimed in claim 14, wherein an electric resistance of a current flowing path between said nearest transfer member and said transfer nip portion is less than an electric resistances of all of current flowing paths between said plurality of transfer members and said transfer nip portion.

19. An image forming apparatus as claimed in claim 14, wherein a contact pressure between said nearest transfer member and said transfer support element is a lowest of all of contact pressures between said plurality of transfer members and said transfer support element.

20. An image forming apparatus comprising:

an image carrier configured to carry a visible image thereon;

a transfer support element configured to contact said image carrier at a transfer nip portion;

a plurality of transfer members configured to apply a transfer bias to said transfer support element, said plurality of transfer members contacting an inner layer of said transfer support element;

wherein an electric resistance of a current flowing path between a nearest of said plurality of transfer members to said transfer nip portion is a lowest of all of electric resistances of current flowing paths between said plurality of transfer members and said transfer nip portion.

21. The image forming apparatus as claimed in claim 20, wherein a contact pressure between the nearest transfer member and the transfer support element is a lowest of all of contact pressures between the plurality of transfer members and the transfer support element.

22. An image forming apparatus comprising:

an image carrier configured to carry a visible image thereon;

a transfer support element configured to contact said image carrier at a transfer nip portion;

a plurality of transfer members configured to apply a transfer bias to said transfer support element, said plurality of transfer members contacting an inner layer of said transfer support element; and wherein a contact pressure between a nearest transfer member located nearest to said transfer nip and the transfer support element is a lowest of all of contact pressures between said plurality of transfer members and said transfer support element.

23. The image forming apparatus as claimed in claim 22, wherein an electric resistance of a current flowing path between the nearest transfer member to said transfer nip portion is a lowest of all of electric resistances of current flowing paths between said plurality of transfer members and said transfer nip portion.

24. An image forming apparatus comprising:

image carrier means for carrying a visible image thereon;

transfer support means for contacting said image carrier means at a transfer nip portion;

transfer means for applying a transfer bias to said transfer support means, said transfer means contacting an inner layer of said transfer support means at an edge of the transfer nip portion; and wherein said transfer means has a medium inherent volume resistance which is less than an inherent volume resistance of said inner layer of said transport support means.

25. An image forming apparatus as claimed in claim 24, further comprising support means contacting said inner layer of said transfer support means for supporting said transfer support means.

26. An image forming apparatus as claimed in claim 24, wherein said transfer means includes a plurality of transfer elements, and a transfer element nearest to the transfer nip portion has the medium inherent volume resistance.

27. An image forming apparatus comprising:

an image carrier configured to carry a visible image thereon;

a transfer support element configured to contact said image carrier at a transfer nip portion;

a transfer member configured to apply a transfer bias to said transfer support element, said transfer member contacting an inner layer of said transfer support element;

a support member configured to contact said inner layer of said transfer support element, said support member located downstream of said transfer member with respect to a moving direction of said transfer support element;

wherein said transfer member has a medium inherent volume resistance which is less than an inherent volume resistance of said inner layer of said transport support element; and wherein a contact pressure between said transfer member and said transfer support element is less than a contact pressure between said support member and said transfer support element.

28. An image forming apparatus as claimed in claim 27, wherein said inherent volume resistance of said transfer member is greater than $1\times10^5$ Ωcm inclusive, and is less than $1\times10^9$ Ωcm.

29. An image forming apparatus as claimed in claim 27, wherein said inherent volume resistance of said inner layer of said transfer support element is greater than $1\times10^7$ Ωcm inclusive, and is less than $5\times10^9$ Ωcm.

30. An image forming apparatus as claimed in claim 29, wherein said inherent volume resistance of an outer layer of said transfer support element is greater than $1\times10^9$ Ωcm inclusive, and is less than $1\times10^{13}$ Ωcm.

31. An image forming apparatus as claimed in claim 27, wherein said transfer member is located below or downstream of said transfer nip portion where said transfer support element is in contact with said image carrier with respect to a moving direction of said transfer support element.

32. An image forming apparatus as claimed in claim 27, wherein said support member is configured to apply said transfer bias to said transfer support element.

33. An image forming apparatus as claimed in claim 27, wherein said transfer member comprises one element selected from the group consisting of a transfer roller, a transfer brush, and a transfer blade.

34. An image forming apparatus as claimed in claim 27, wherein said transfer support element comprises a transfer belt.

35. An image forming apparatus as claimed in claim 27, wherein said image carrier comprises a photoconductive belt.

36. An image forming apparatus as claimed in claim 27, wherein said transfer support element comprises an intermediate transfer belt.

37. An image forming apparatus as claimed in claim 27, wherein the transfer support element is an intermediate transfer belt onto which an image is transferred from said image carrier.

38. An image forming apparatus comprising:

an image carrier configured to carry a visible image thereon;

a transfer support element configured to contact said image carrier at a transfer nip portion;

a transfer member configured to apply a transfer bias to said transfer support element, said transfer member contacting an inner layer of said transfer support element;

a support member configured to contact said inner layer of said transfer support element, said support member located downstream of said transfer member with respect to a moving direction of said transfer support element;

wherein said transfer member has a medium inherent volume resistance which is less than an inherent volume resistance of said inner layer of said transport support element; and wherein said support member is configured to apply said transfer bias to said transfer support element.

39. An image forming apparatus as claimed in claim 38, wherein said inherent volume resistance of said transfer member is greater than $1\times10^5$ Ωcm inclusive, and is less than $1\times10^9$ Ωcm.

40. An image forming apparatus as claimed in claim 38, wherein said inherent volume resistance of said inner layer of said transfer support element is greater than $1\times10^7$ Ωcm inclusive, and is less than $5\times10^9$ Ωcm.

41. An image forming apparatus as claimed in claim 40, wherein said inherent volume resistance of an outer layer of said transfer support element is greater than $1\times10^9$ Ωcm inclusive, and is less than $1\times10^{13}$ Ωcm.

42. An image forming apparatus as claimed in claim 38, wherein said transfer member is located below or downstream of said transfer nip portion where said transfer support element is in contact with said image carrier with respect to a moving direction of said transfer support element.

43. An image forming apparatus as claimed in claim 38, wherein said transfer member comprises one element selected from the group consisting of a transfer roller, a transfer brush, and a transfer blade.

44. An image forming apparatus as claimed in claim 38, wherein said transfer support element comprises a transfer belt.

45. An image forming apparatus as claimed in claim 38, wherein said image carrier comprises a photoconductive belt.

46. An image forming apparatus as claimed in claim 38, wherein said transfer support element comprises an intermediate transfer belt.

47. An image forming apparatus as claimed in claim 38, wherein the transfer support element is an intermediate transfer belt onto which an image is transferred from said image carrier.

* * * * *